United States Patent [19]

Capelle

[11] Patent Number: 4,688,271

[45] Date of Patent: Aug. 25, 1987

[54] WAIST BAND FOR WOMEN'S GARMENTS

[76] Inventor: Catherine L. Capelle, 3996 Germania, Cincinnati, Ohio 45227

[21] Appl. No.: 944,369

[22] Filed: Dec. 22, 1986

Related U.S. Application Data

[63] Continuation-in-part of Ser. No. 865,432, May 21, 1986.

[51] Int. Cl.[4] ..... A41D 1/14

[52] U.S. Cl. ..... 2/220

[58] Field of Search ..... 2/256, 220, 255, 231, 2/236, 221

[56] References Cited

U.S. PATENT DOCUMENTS

| | | | |
|---|---|---|---|
| 1,584,765 | 5/1926 | Gillette | 2/236 |
| 1,614,965 | 1/1927 | Margolith | 2/236 |
| 2,946,064 | 7/1980 | Dieterle | 2/220 |
| 3,042,932 | 7/1962 | Eppy | 2/258 |

*Primary Examiner*—Doris L. Troutman

*Attorney, Agent, or Firm*—Joseph Patrick Burke

[57] ABSTRACT

The present disclosure is directed to an improved waist band stay for women's garments comprised of a substantially rectangular, thin, one-piece, laterally free-riding, readily insertable and removable, strip of polypropylene plastic having substantially rounded corners at its leading end with a hanger opening centrally located in the vicinity of said leading end and indicia (markings) located thereon along the length thereof, e.g., calibrated in centimeters and/or inches (and portions thereof) to indicate length and make it simple for the user to cut the stay to the length appropriate for, viz., slightly less than e.g., from about 0.125 inch to about 1.0 inch less than, the wearer's waist measurement. The premeasured and marked strips usually range in width from about ½ to 1¾ inches and in lengths from about 30 to about 48 inches with a substantially uniform thickness of about 0.02" to about 0.04" plus or minus 10%. The user cuts the trailing end of the waist band stay to a length slightly less than her waist measurement to allow the stay to ride freely laterally within the garment interfacing and makes a button-hole shaped opening (slightly larger than the waist band stay width, e.g., about one-eighth inch larger) in the inside of the waist band area to allow insertion and removal of the stay which rides freely laterally within the interfacing.

This invention contemplates ladies garments, e.g. skirts, slacks, etc., having waist bands whose waist band open area contains a free riding waist band stay contained in the interfacing thereof wherein the waist band stay has a length slightly less, e.g. from about 0.125" to about 1.0" less, than the waist size of the garment.

8 Claims, 3 Drawing Figures

WAIST BAND FOR WOMEN'S GARMENTS

This application is a continuation-in-part of my earlier application, Ser. No. 865,432, entitled "Improved Waist Band Stay" filed May 21, 1986.

The women's garment waist band stay of the present invention is comprised of a substantially rectangular, thin, one-piece, laterally free-riding readily insertable and removable strip of polypropylene plastic having substantially rounded corners at the leading end, a hanger opening centrally located in the vicinity of said leading end thereof and preferably having marking (indicia) located along the length thereof in centimeters and/or inches to enable the user to approximate closely her waist measurement when the user cuts same to slightly less than her own individual waist size. The strips usually range in width from about ½" to about 1¾", are of substantially uniform thickness and have a thickness of about 0.02" to about 0.04" plus or minus 10%, more usually a thickness of about 0.03" plus or minus 10%, and are of any desired length. The user cuts the pre-measured strip, usually having lengths of 30 inches or 48 inches, to a length slightly less, e.g. from about 0.125" to about 1.0", than her waist size (measurement) to allow it to be free-riding laterally within the garment waist band open area. The width of said polypropylene strip is chosen to be about one-eighth inch less than the open area within said garment waist band, viz., provide about 0.125 inch vertical clearance, which is sufficient to enable said strip to be inserted easily within and removed from said open area within the garment waist band, yet inadequate to permit any significant up and down movement therein.

BACKGROUND OF THE INVENTION AND THE PRIOR ART

In women's unbelted garments as manufactured and sold, e.g., skirts and slacks, usually inadequate provision is made for a desired combination of vertical rigidity and lateral comfort within the waist band interface. Consequently the waist band becomes wrinkled, rolled, crimped, etc., regardless of the shape of the wearer, viz., whether the woman has a less than average, average or greater than average waist measurement. This wrinkling/rolling/crimping, etc., detracts from the appearance of the garment while it is being worn and makes it difficult to preserve a freshly pressed appearance in the skirt or pair of slacks as it is being worn.

The prior art has provided various forms of waist bands in various men's and women's garments, but none of the prior art accomplishes the combination of advantages obtained by the present invention.

U.S. Pat. No. 717,159 issued to F. E. Bush discloses a shirring band for skirts. The band is made of two pieces, the final portions of which are joined, utilizing a hook and eye arrangement to form interlocking members having lateral rigidity. The opposite ends of the sections are provided with oppositely projecting spurs which are preferably hook-shaped and are adapted to interlock with suitable eyelets secured to the inner wall of the skirt band. It seems clear that the shirring band of the Bush patent must be tailor-made to the waist of the wearer and does not accommodate change in waist measurement as would occur after weight loss. Moreover, it does not appear that it can be removed readily for desired garment dry cleaning, washing, etc., and then reinserted without difficulty.

U.S. Pat. No. 3,194,242 to A. Marchisella is directed to anti-roll stays for elastic waist bands of girdles, etc. In the Marchisella patent, a pair of stays 10 at opposed locations are attached to tunnel 22 around marginal portions only of the circumference of the girdle waist band to apply moderate pressure at the stays. Moreover, these girdle stays 10 are stated to be about 6 to 12 inches long by about one-half to one inch wide and leave substantial areas of no vertical reinforcement particularly in the front of the girdle waist area. The front of the garment is the area where roll-up is more likely to occur. Since the pair of stays 10 are sewn into the waist band area of the girdle to mechanically anchor said stays therein, they are difficult to remove. Additionally these stays have their upper and lower edges narrower in cross-section that their their middle thickness viz., are not of uniform thickness and hence more expensive to manufacture when made in such configuration.

U.S. Pat. No. 835,192, issued to A. W. Logan, is directed to a continuous thin metallic strip or band, much in the nature of a belt, for men's trousers to prevent sagging thereof. The belt must apparently be tailor-made to the waist measurement of the wearer inasmuch as the waist band hook 6 is secured by insertion into widened end vertical slot 3 and thus extending within bent portion 4. Also it is apparent that the Logan device requires loops 10 to extend up at least from the top of stiffening band 1 and through lining 8. Such loops would detract from the continuity of ladies garments, e.g., the skirt or slack waist bands and could prove unsightly.

U.S. Pats. Nos. 2,099,356 and 2,166,333 are both issued to K. Von Daeniken. These patents are directed to springy steel lapel stays for coats to keep the lapels from wrinkling and becoming unsightly. In each of these patents, the strip is held against lateral movement by a barb 3, which must pierce fabric damaging same. Moreover such piercing could prove painful to the wearer if such device were attempted to be utilized in a thin skirt or slacks waist band.

U.S. Pat. No. 3,042,932 issued to M. Eppy is directd to two, e.g. vinyl resin, strips inserted in pockets in the front portion only of garments. The individual pockets are closed, e.g., by snap fasteners and hence do not communicate with one another. These pockets terminate short of the hip portion of the garment with which they are used so no smooth, continuous vertical support of the garment's substantially entire waistband area is disclosed, possible or intended by the Eppy patent.

U.S. Pat. No. 2.946,064 issued to C. Dieterle is directed to a detachable belt, particularly suitable for corpulent persons, positioned in such a way that the elastic strap 1 is situated at the level of the wearers' hips. This strap is provided at one end with a hook 2 and the other end carries two clasps 3. The belt is formed of two widened side portions, or strips, 5 sewn to a narrower stiffening strap 1 and covered by a satinette lining 7. One vertical stiffening strip 9 is located at the rear portion only of each widened portion 5. Thus the Dieterle belt is not capable of providing vertical rigidity around substantially the entire waist band area of a garment. The inner face of the elastic strap 1 can carry a strip of rubber intended to adhere to the underclothes of the person wearing the belt.

U.S. Pat. No. 1,614,965 issued to M. Margolith is directed to a waistband for (men's) trousers which occupies selected portions (areas) of the guiding space of the trousers waist band area so that the belt, preferably of canvas having a roughened surface, is passed out of these guiding space areas through slits 25 and lie exposed along the interior of the waist band at the exposed areas which is stated by the patentee to increase the binding qualities of the canvas belt with respect to the wearer's waist without materially affecting the outside contour of the waist band. It is clear that utilization of the Margolith device requires a good deal of skilled stitch work using separate linings with many layers of stitching to occupy selected portions of trouser waist band portions and using spaced transverse slits to define separate exposed and non-exposed areas in conjunction with canvas stiffening strips 13 and 14 having two portions. The waist binding qualities of the exposed interior roughened canvas surfaces of the Margolith canvas belt and interior portions of canvas stiffening strips 13 and 14 fail to compare with the comfortable vertical support along the waist band's substantially entire length as provided by this invention to women's garments with which it is used.

U.S. Pat. No. 1,584,765 issued to M. G. Gillette is directed to a suspender attaching means comprising an inner hip engaging stiff heavy fabric, e.g., heavy canvas, band 9 and a lower trouser lining 10 of relatively soft materials. The band 9 is preferably held in position by stitching 12. This suspender attaching means can be used in conjunction with a conventional belt 7 which is positioned interiorly of the trousers about the hip engaging portion of the trousers with the ends of the belt 7 passing through slits 4 and 5 and being united by buckle 8. The major portion of the belt may thus be hidden from outside view while it is interiorly carried by flaps 3 or a continous strip extending around the inner side of the hip engaging portion of the trousers to form a housing for the belt. The hip belt 7 may be used without the use of suspenders and vice versa. Either way Gillette fails to provide vertical support along the waist band area in the way provided by the present invention. Whether the hip belt 7 is worn or not, the Gillette structure incorporates spaced metallic eyes or riveted sockets 13 to provide means for attaching suspender tabs 14 carrying metallic hooks 15 adapted to spring into eye or socket 13 at separated locations along nonflexible band 9.

DETAILED DESCRIPTION OF THE INVENTION

Figure 1:
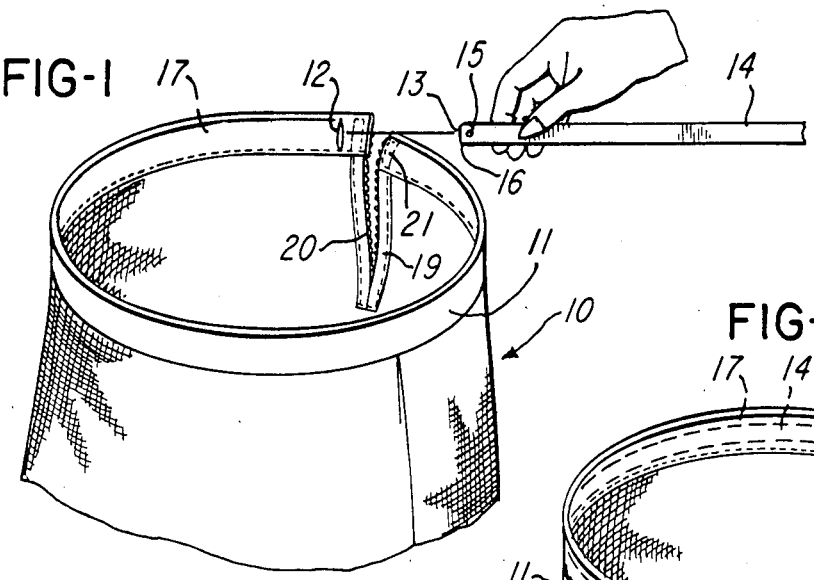
FIG. 1 of the drawings is a partial isometric view showing a garment, e.g., slacks or skirt, prior to insertion of applicant's improved waist band stay device.

Included among the benefits of the waist band of the present invention is that it can be manufactured of low cost polypropylene which in a thin layer, e.g., from about 0.02 to about 0.04 inch thick plus or minus ten percent, and more usually about 0.03 inch thick plus or minus ten percent, laterally flexes easily enabling it to conform readily to the wearer's waist without sacrificing vertical reinforcement. Polypropylene offers a combination of outstanding properties not found in any other thermoplastic material. It is lightweight, possesses high tensile strength, impact resistance, high compression strength, has excellent dielectric properties, resists most alkalies and acids, retains stiffness and flex, has low moisture absorption, is non-toxic and non-staining, is easily fabricated, has high heat resistance, does not environmentally stress crack when exposed to soap or detergent, and exhibits what is known as a living hinge effect.

These and other properties of polypropylene are described, e.g., in Penn Fibre Non-Metallic Materials Profile, Materials Recognition Bulletin Series entitled Polypropylene, a one-sheet bulletin bearing no date of publication, but published by Penn Fibre and Specialty Company, Inc., located at 4343 G Street, P. O. Box 4890A, Philadelphia, PA 19124-4391.

For example, with regard to polypropylene's living hinge effect referred to above, applicant has observed that when the waist band stay of this invention is placed within a skirt and the skirt is hung on the clips of a skirt hanger, the polypropylene waist band stay becomes pinched during hanging when the clips bear down on said stay. However, this pinching is only temporary because when released from this clamping pressure of the clips, the polypropylene waist band stay flexes by itself back to it prehung shape to accommodate the normal waist band contours of the wearer.

The waist band stay of this invention has a universal fitting feature and can easily be custom made by the purchaser to fit her garment waist size simply by the use of scissors.

The inproved waist band stay of this invention can readily be fitted into any woman's slacks or skirt garments simply by making a "button-hole" shaped opening 12 in skirt or slacks 10 in the interior waist band area 11 thereof. Leading end 13 of waist band stay 14 has substantially rounded ends 16 and a centrally located opening(s) 15 for the purpose of hanging said waist band stay on hooks, coat hangers, etc., when not in use. Leading end 13 of the stay 14 is inserted into opening 12. Stay 14 is then progressively moved through this opening along the waist band open area 17 until it is stopped at end portion 18 of this open area, viz., at the selvage area of the rear or side zipper 20 or the area where the buttons (not shown) are vertically placed to allow closure of the waist portion. The selvage 19 intersects at the end seam 21 of the open portion 17, viz., as shown in FIG. 2.

Figure 2:
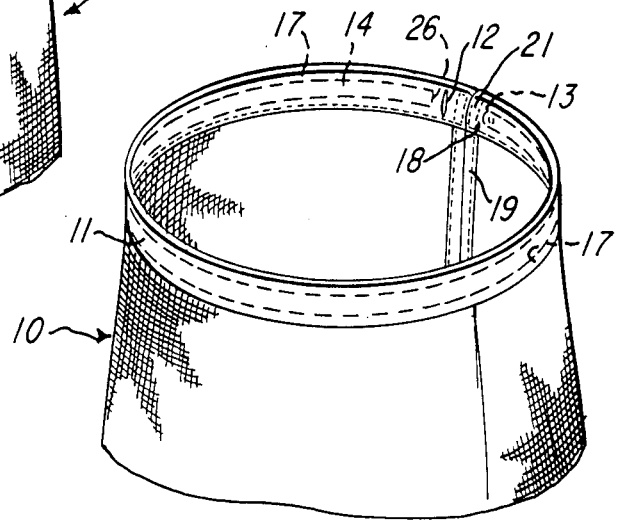
FIG. 2 is a partial isometric view showing the waist band stay in place within the interfacing of the garment waist band.

As is apparent from FIG. 2, the use of the present device does not in any way interfere with the zipper, hooks, or button-type closures of the garment with which it is used. Moreover, waist band stay 14 freely rides laterally and has slight vertical clearance, e.g., about one-eighth inch less in vertical dimension than the open area height to permit easy insertion and removal within the waist band stay's vertically open area or space 17 and is easily insertable and removable via opening 12.

Markings 27 (indicia) are provided along the length of waist band stay 14 to calibrate same in inches and/or centimeters, thus enabling the user to "eye ball" the approximate place to cut stay 14 to a length slightly less than the garment waist measurement.

Figure 3:
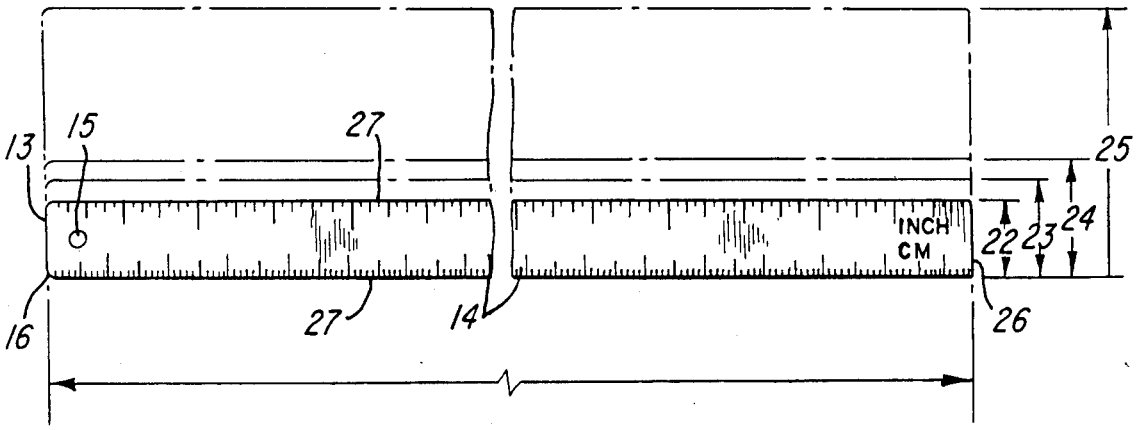
FIG. 3 is a plan view showing waist bands of various widths and having length measurement markings.

As is shown in FIG. 3, waist band stay 14 can be manufactured in any desired lengths and widths. The width usually ranges from about $\frac{1}{2}$ inch, e.g., as shown at 22 and up to a width of about $1\frac{3}{4}$ inches as shown at 25 with incremental one-eighth inch widths, e.g., as shown at 23 and 24. The length of stay 14 can be of any desired length, which usually ranges from about 30 inches to about 48 inches. The thickness of the stay 14 ranges from about 0.02 to about 0.04 inch plus or minus 10 percent, more usually about 0.03 inch plus or minus 10 percent.

When it is desired to launder or dry clean the garments, the waist band stay 14 can be removed readily therefrom by retrieving it through opening 12. However, polypropylene waist band stay 14 will not be damaged nor damage the garment if left in the waist band opening while washing or dry cleaning. Space 17 is provided within the interfacing of the garment 10 so that the waist band is free riding. Opening 15 provides a way to store the waist band when not in use. It can be hung in one's closet on a hook or coat hanger.

It is also within the purview of this invention to provide garments, such as skirts, slacks, etc., having a waist band stay, as described above, precut to a length slightly less, e.g. from about 0.125 to about 1.0 inch less, than the wearer's waist measurement riding freely laterally and vertically within the garment interfacing open area and having a vertical clearance therein of about one-eighth inch.

Thus it will be observed that the present invention provides an inexpensive, comfortable, one-piece waist band stay capable of use in more than one garment wherein the waist band stay can remain in said garment while it is washed or dry cleaned without harm to the garment or the waist band stay. The waist band stay can be cut to the desired length by the user with a common household tool, scissors, and provides vertical support within the waist band area far above and beyond that offered by interfacing even when the woman's garment has a belt with it. The waist band stay is comfortable and not readily noticeable while being worn even to widths of one and three quarter inches, and is practical and easy to use, requiring no stitching. It conforms (molds) to the wearer's waist and achieves the primary objectives of smart and aesthetic appearance, comfort, convenience, support, inexpensiveness and practicality in use. Moreover, the hanger/hook opening allows the user to hang the waist band stay on a hanger or closet hook.

It will be noted that the one-piece waist band stay is continuous in length yet its length is slightly less than the actual length of the waist size or measurement of woman's garment 10 as will be observed from FIG. 2, which shows that trailing end 26 of waist band stay 14 does not contact its leading end 13.

I claim:

1. An improved, laterally free riding waist band garment stay for women's clothing comprised of a substantially rectangular, thin, one-piece, laterally free-riding, polypropylene strip having a thickness ranging from about 0.02 to about 0.04 inch plus or minus 10 percent, substantially rounded corners at its leading end, a hanger opening centrally located in the vicinity of said leading end and measuring indicia located along the length thereof to facilitate the user in tailor-making the stay to a length slightly less than the user's waist size.

2. An improved waist band stay as in claim 1 wherein said measuring indicia are graduated markings in inches and/or centimeters and divisions thereof.

3. An improved waist band stay as in claim 1 wherein the length of said stay is from about 0.125" to about 1.0" less than the user's waist size.

4. An improved waist band stay as in claim 1 wherein said improved waist band stay has a substantially uniform thickness.

5. A woman's garment having a waist band whose waist band open area contains a free-riding improved waist band stay according to claim 1 having a length slightly less than said garment waist size.

6. A woman's garment having a waist band whose waist band open area contains a free-riding improved waist band stay according to claim 2 having a length slightly less than said garment waist size.

7. A woman's garment having a waist band whose waist band open area contains a free-riding improved waist band stay according to claim 3.

8. A woman's garment having a waist band whose waist band open area contains a free-riding improved waist band stay according to claim 4 having a length slightly less than said garment waist size.

* * * * *